United States Patent [19]

Yasui et al.

[11] Patent Number: 4,708,008

[45] Date of Patent: Nov. 24, 1987

[54] VOLUME CONTROL SUPERPLASTIC FORMING

[75] Inventors: Ken K. Yasui, Fountain Valley; Neil R. Williams, Huntington Beach; Richard C. Ecklund, Lakewood; Masashi Hayase, Fountain Valley; Robert J. Walkington, Garden Grove, all of Calif.

[73] Assignee: McDonnell Douglas Corporation, Long Beach, Calif.

[21] Appl. No.: 813,600

[22] Filed: Dec. 26, 1985

[51] Int. Cl.[4] ..... B21D 26/02

[52] U.S. Cl. ..... 72/60; 72/38; 72/54; 72/709; 29/421 R

[58] Field of Search ..... 72/38, 54, 56, 58, 63, 72/4, 10, 32, 60, 709; 29/421 R

[56] References Cited

U.S. PATENT DOCUMENTS

| | | | |
|---|---|---|---|
| 3,340,101 | 9/1967 | Fields, Jr. et al. | 72/364 |
| 4,233,829 | 11/1980 | Hamilton et al. | 72/38 |
| 4,352,280 | 10/1982 | Ghosh | 72/38 |
| 4,354,369 | 10/1982 | Hamilton | 72/38 |
| 4,489,579 | 12/1984 | Daime et al. | 72/38 |
| 4,513,497 | 4/1985 | Finch | 29/727 |

FOREIGN PATENT DOCUMENTS

| | | | |
|---|---|---|---|
| 576143 | 10/1977 | U.S.S.R. | 72/63 |

*Primary Examiner*—Lowell A. Larson
*Assistant Examiner*—David B. Jones
*Attorney, Agent, or Firm*—Paul T. Loef; George W. Finch; Donald L. Royer

[57] ABSTRACT

An apparatus and method for controlling the superplastic forming process by measuring and controlling the volume displaced by the blank being formed so as to measure total strain or surface area increase of the blank.

7 Claims, 2 Drawing Figures

VOLUME CONTROL SUPERPLASTIC FORMING

BACKGROUND OF THE INVENTION

This invention pertains to the field of metal forming and, more particularly, to the forming of materials which exhibit superplastic characteristics.

Super plasticity is the characteristic demonstrated by certain metals which exhibit extremly high plasticity in that they develop unusually high tensile elongations with minimum necking when deformed within limited temperature and strain rate ranges. The methods used to form the superplastic materials capitalize on these characteristics and typically employ gas pressure to deform sheet material into or against a configurational die to form the part. Diffusion bonding is sometimes associated with the process. Many U.S. Patents have issued which relate to the process itself, e.g., U.S. Pat. No. 3,340,101 to D. S. Fields, Jr., et al., U.S. Pat. No. 4,117,970 to Hamilton, et al., and U.S. Pat. No. 4,233,829, also to Hamilton, et al. Other processes combine diffusion bonding with the superplastic forming to produce much more complex structures such as U.S. Pat. No. 4,217,397 to Hayase, et al. to produce sandwich structures. All of these references teach a process which attempts to control stress in that they control the Pressure against the sheet being deformed versus time. One known exception to this rule is U.S. Pat. No. 4,489,579 to J. P. Daime, et al., which will be discussed infra. Furthermore, when the process is controlled by pressure versus time, there is no positive way of knowing where the specimen is at any given time.

The classic equation which defines the relationship between the variables in superplastic forming is:

$$\delta = K\dot{\epsilon}^m$$

where m is the strain rate sensitivity, $\delta$is stress, $\dot{\epsilon}$is strain rate, and K is a constant.

In the absence of strain hardening, the higher the value of m, the higher the tensile elongation. Solving the classic equation for m, $$m = \frac{\ln\delta - \ln K}{\ln \dot{\epsilon}}$$

In addition to strain rate, the value of m is also a function of temperature and microstructure of the material. The uniformity of the thinning under biaxial stress conditions also correlates with the value of m. For maximum stable deformation, superplastic forming is optimally performed at or near the strain rate that produces the maximum allowable strain rate sensitivity. However, because the strain rate sensitivity, m, varies with temperature as well as strain rate and microstructure, which in turn varies with temperature, time and strain, m is, as a practical matter, constantly varying during the process. This is borne out by the fact that rather low forming stresses may produce the entire deformation if applied for a sufficient amount of time. However, significantly less time is required at increased forming stresses Furthermore, it should be reasonably obvious that the strain rate varies at different instants on different portions of the formation inasmuch as stress levels are non uniform. The more complex the part, the more variation there is, and, therefore, strain rate differs over the various elements of the formation. Since strain rate sensitivity, strain rate, stress and microstructure are all interdependent and varying during the process, the relationship is theoretical. As a practical matter, there is no predictable relationship which can be controlled so as to form all portions of complex parts at the best strain rate sensitivity and the best strain rates. However, the artisan can plot strain rate sensitivity (m) against strain rate ($\dot{\epsilon}$) and stress ($\sigma$) against strain rate ($\dot{\epsilon}$) and establish the optimum ranges to be used as guides. Those skilled in the art must then select and control those portions of the formation which are more critical to successful forming while maintaining all other portions at the best or less than the best strain rates which necessarily becomes the overall optimum rate. Excessive strain rates cause rupture and must be avoided.

As indicated supra, a single reference that teaches other than controlling the process by controlling pressure versus time is Daime, et al. This reference teaches a device for monitoring the forming steps by providing a tube which penetrates the die and engages a portion of the blank to be formed. As the blank is formed, the tube advances through the die directly as that portion of the blank is formed. Means are provided to provide a signal at predetermined amounts of advancement of the tube. The reference further teaches electrical contacts at recess angles of the die which are closed when the blank arrives at the electrical contact. Daime, et al. does not teach measurement of total strain or total deformation of the blank at any given time in the process or the volume of the space displaced by the deformed blank at any given time in the process. It teaches only the measurement of the deformation of the portion of the blank contacting the tube.

It is an object of the present invention to provide an apparatus and method for controlling superplastic forming processes by measuring and monitoring the incremental volume displaced by the blank being formed or total strain, i.e., surface area increase of the blank.

DESCRIPTION OF THE PREFERRED EMBODIMENT

Figure 2:
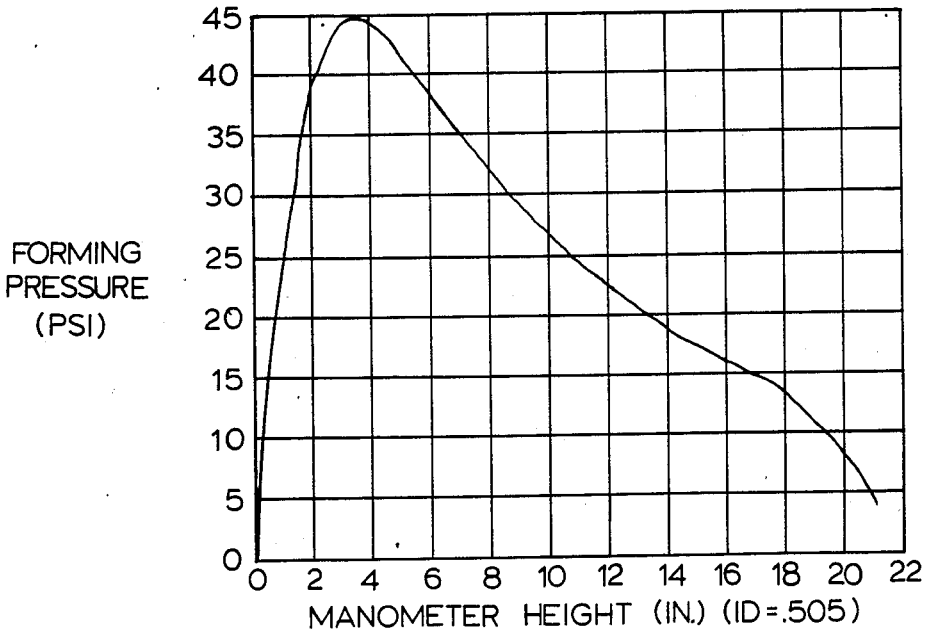
FIG. 2 is a curve showing the relationship between forming pressure and manometer height which is a measure of the volume displaced by the blank being formed during the process of superplastic forming of a 3.5 inch diameter by 3.5 inch deep cylinder.

A relationship between stress, $\sigma$, and strain rate, $\dot{\epsilon}$, at the forming temperature for any given material must be established either analytically or experimentally by methods well known in the art. Using this data, total deformation of the part being formed can be approximated by analyzing the geometry of the particular part being formed as a function of applied stress, in the form of pressure, to deform the blank. Such a curve is shown in FIG. 2 for a 3.5 inch diameter by 3.5 inch deep cylinder against the displacment of the manometer which is measuring the volume displaced by the blank in the deformation process or total deformation. Typically, of course, a manometer reads pressure in inches or feet of the liquid displaced. However, the volume displaced is readily calculated knowing the inside diameter of the manometer. Of course, the pressure versus displacement curve may be determined analytically or experimentally or by a combination of analytical and experimental methods In any case, the analytical method may be compared and corrected by experimental results in as much as the displacement measured is a positive indication of the incremental deformation of the blank at any phase in the process.

Figure 1:
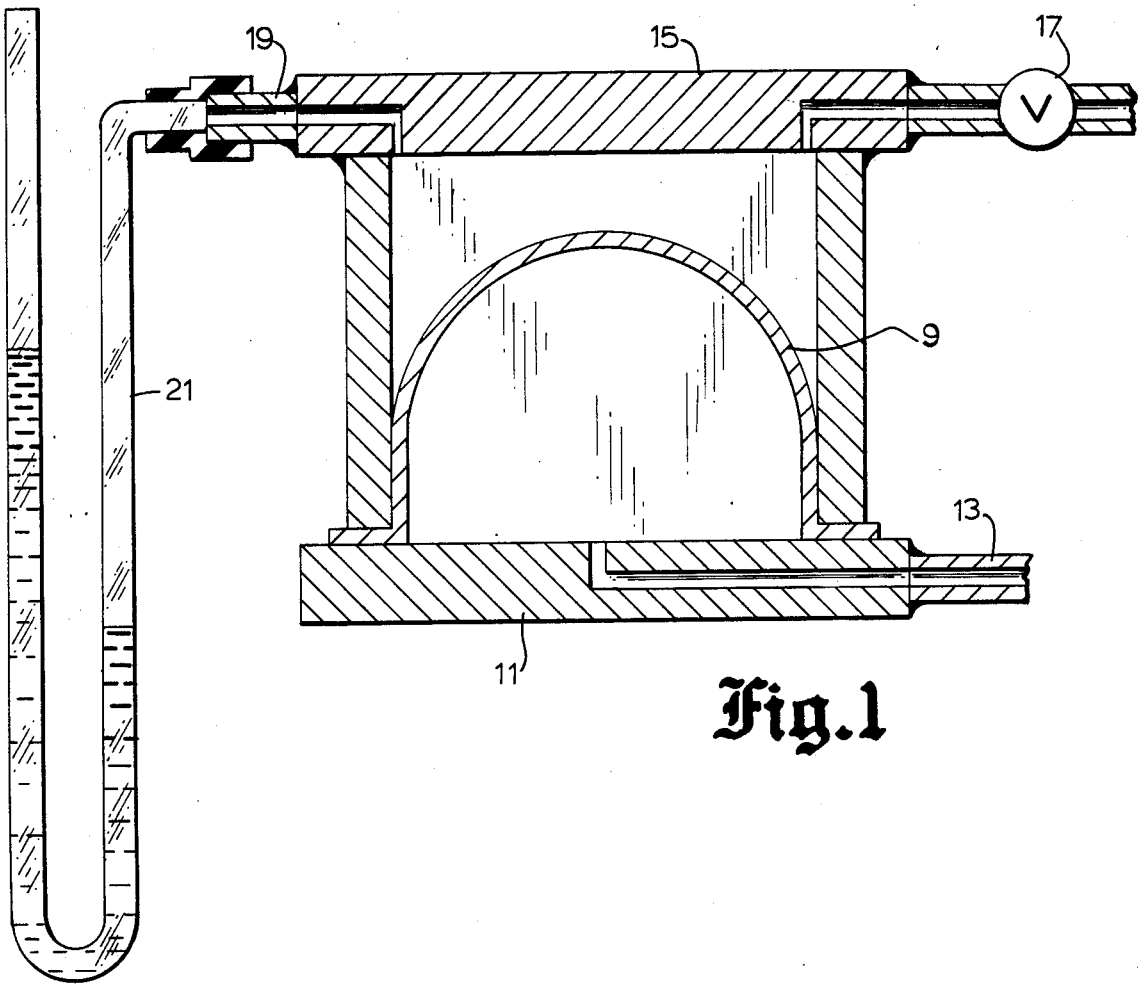
FIG. 1 is a schematic of an apparatus which measures, for purposes of control, the incremental volume displaced by the blank being formed during the superplastic forming process.

FIG. 1 is a schematic of the apparatus used in the process showing the blank 9 partially formed. The forming tool consists of a base 11 with provisions for a forming gas inlet 13. A configurational die 15 is shown restraining the blank 9 by clamping means, not shown. The configurational die is shown with a purge gas inlet valve at 17 and an outlet port 19 connected to a liquid manometer 21 which reflects a differential pressure associated with the partial forming of the blank 9. The outlet port 19 must penetrate the die cavity where the last portion of the blank is formed. Obviously, there can be no leakage between the blank and the manometer. Of course, the manometer may be replaced by a pressure transducer or any other means for measuring the gas displaced by the incremental forming of the blank.

While a simple configurational die is shown, a more complex die may require more experimentation, but in any case, measurement of the volume displaced by the incremental deformation of the blank is a positive indication of where the blank is at any given time in the process.

The actual steps in superplastic forming, as taught herein, consist of removing the manometer from the outlet port 19 and applying purge gas to purge the space above the unformed blank 9. The blank must then be heated by means not shown to a temperature above superplasticity. Inert forming gas is applied at 13 through a pressure regulator (not shown) and the pressure is controlled to follow the curve as indicated in FIG. 2, i.e., the pressure is maintained for whatever time required to produce the associated manometer differential height (which measures the displacement of the gas by the blank being formed). Of course, accuracy may dictate correction for temperature and pressure of the gas in the manometer using the gas laws.

An alternative embodiment involves the use of a curve of the displaced volume by the deformed blank versus time. Here the volume displaced by the deformation of the blank is controlled against time by varying the pressure Either embodiment is readily adaptable to automatic control of the process using electronic sensing devices and a microprocessor as is well known in the art.

Numerous variations and modifications can be made without departing from the present invention. Accordingly, it should be understood that the form of the present invention described above and shown in the accompanying drawings is illustrative only and is not intended to limit the scope of the present invention.

What is claimed is:

1. An apparatus for superplastically forming a blank, comprising:

a configurational die having a contour which is complementary to the shape of the part being formed;

means for holding said blank in said die at the forming temperatures;

meand for applying differential gas pressure against opposing sides of said blank so as to deform said blank into said configurational die;

means for containing the gas on said low pressure side of said blank; and means for directly measuring the volume of asid gas displaced by the deformation of said blank so that said gas pressure can be controlled to produce a predetermined relationship between pressure and deformation of said blank.

2. The apparatus of claim 1 wherein said means for measuring the volume displaced by the deformation of said blank is a manometer.

3. The apparatus of claim 1 wherein said means for measuring the volume displaced by the deformation of said blank is a pressure transducer.

4. An apparatus for superplastically forming a blank comprising:

a configurational die having a contour which is complementary to the shape of the part being formed;

means for holding said blank in said die at the forming temperature;

means for applying differential gas pressure against opposing sides of said blank so as to deform said blank into said configuration die;

means for containing the gas on said low pressure side of said blank; and maeans for directly measuring the volume of said gas displaced by the deformation of said bank so that said gas pressure can be applied so as to deform said blank against time at a predetermined relationship.

5. The apparatus of claim 4 wherein said means for measuring the volume displaced by the deformation of said blank is a pressure transducer.

6. The apparatus of claim 4 wherein said means for measuring the volume displaced by the deformation of said blank is a manometer.

7. A method of forming a metal blank in a configurational die having a contour which is complementary to the shape of the part being formed, which comprises:

holding said blank in said configurational die;

applying differential gas pressure across said blank so as to deform said blank into said configurational die; and measuring, directly, the volume of gas displaced by the deformations of said blank so that said gas pressure can be controlled to produce a predetermined relationship between pressure and deformation of said blank.

* * * * *